US005413468A

United States Patent [19]

Tuckey

[11] Patent Number: 5,413,468

[45] Date of Patent: May 9, 1995

[54] PULSE DAMPER

[75] Inventor: Charles H. Tuckey, Cass City, Mich.

[73] Assignee: Walbro Corporation, Cass City, Mich.

[21] Appl. No.: 292,937

[22] Filed: Aug. 18, 1994

Related U.S. Application Data

[63] Continuation-in-part of Ser. No. 156,428, Nov. 23, 1993, abandoned.

[51] Int. Cl.[6] ..... F04B 11/00

[52] U.S. Cl. ..... 417/540; 417/366

[58] Field of Search ..... 417/540, 541, 542, 543, 417/366

[56] References Cited

U.S. PATENT DOCUMENTS

| | | | |
|---|---|---|---|
| 4,181,473 | 1/1980 | Ina | 417/365 |
| 4,401,416 | 8/1983 | Tuckey | 417/283 |
| 4,521,164 | 6/1985 | Tuckey | 417/307 |
| 4,596,519 | 6/1986 | Tuckey | 418/15 |
| 5,035,588 | 7/1991 | Tuckey | 417/540 |

*Primary Examiner*—Richard A. Bertsch
*Assistant Examiner*—Peter Konytnyk
*Attorney, Agent, or Firm*—Barnes, Kisselle, Raisch, Choate, Whittemore & Hulbert

[57] ABSTRACT

A damper in a self-contained electrically operated fuel pump for vehicle engines incorporating a positive displacement pumping element. The damper has a hollow toroidal flexible element in contact with the liquid fuel discharged from the pump for absorbing pulsations. A retainer with a locating plate on one side of the damper centers it in the pump housing and has resilient circumferentially spaced, radial fingers extending over and around the periphery of the toroid to confine it against destructive expansion while permitting limited expansion and contraction needed to absorb fuel pressure pulsations in pump operation.

13 Claims, 2 Drawing Sheets

PULSE DAMPER

REFERENCE TO CO-PENDING APPLICATION

This is a continuation-in-part of U.S. patent application Ser. No. 08/156,428 filed Nov. 23, 1993, and abandoned in favor of this application.

FIELD OF INVENTION

Pulse dampers for electric fuel pumps using a rotary pump and electric drive housed together for mounting on a vehicle or in a vehicle fuel tank.

BACKGROUND OF THE INVENTION

Rotary fuel pumps driven by an electric motor have been utilized for some years in some vehicles either as original equipment or as appliances to supplement the original fuel supply system. The pump and power unit are frequently in a common housing as shown, for example, in U.S. Pat. No. 4,401,416, issued Aug. 30, 1982 to Charles H. Tuckey.

Since the pumps are frequently mounted in the fuel tanks of a vehicle, the noise factor is extremely important. A pump under load will normally produce more noise and this may be audible as a humming noise, to an annoying degree, to passengers in the vehicle.

It will be appreciated that in the pumping cycle, as one pumping cell is exhausting, another cell is taking in fluid at the same time. In other words, intake and exhaust pressure waves are timed with one another, and normally the quantity of fluid being exhausted from each cell is the same as that being taken in by another cell. It has been noted that pressure waves or pulses are present at the inlet, as well as the outlet, at all operating pressures.

It is an inherent characteristic of a positive displacement pump to produce slight pressure pulses each time one of the multiple vanes passes through its pumping cycle. For example, a roller vane rotary pump produces an audible humming noise when operating at system pressure. This noise has a tendency to increase as the output pressure requirement is increased.

One must acknowledge and deal with the extreme pressure differential between the inlet and exhaust sides of the pump. For instance, the inlet zone is usually at an average pressure close to atmospheric; and the outlet zone average pressure is much higher, i.e., 60 psig or more depending upon the operating pressure requirement of the pump.

It has been a desire of manufacturers and users of positive displacement rotary pumps to reduce or eliminate pressure pulses in order to achieve a smooth, pulse-free flow of fluid out of a pump at desired operating pressure.

Hollow pulse absorbing chambers in fuel pumps have been proposed previously as exemplified in U.S. Pats. to Yoshifumi, No. 4,181,473, issued Jan. 1, 1980 and to Tuckey, No. 4,521,164, issued Jun. 4, 1985. U.S. Pat. No. 5,035,588 issued Jul. 30, 1991 to Charles H. Tuckey discloses a hollow pulse modulator of a flexible plastic material formed by a blow molding process which has air trapped therein.

SUMMARY OF INVENTION

The present invention is directed to hollow toroidal pressurized pulse modulator mounted in a fuel pump. The modulator is disposed between the pump outlet exhaust zone and the outlet fitting of the pump. Thus, each time a pressure peak occurs in the exhaust fluid, the pressure compresses the resilient member, thereby reducing the pressure pulses at the outlet of the pump.

Preferably, a hollow, toroidal pressurized element is positioned in a pump housing in a pump outlet area. A centering plate is provided to partially surround the element with spaced radial fingers formed around the periphery of the toroid to confine it against undue expansion. The center of the plate locates the toroid centrally in the pump housing.

In the use of pressurized toroidal pulse modulators, it has been found that the flexible toroids may have a tendency to expand or balloon during inactivity of the pump which decreases their useful life and may cause interference with the pumping mechanism located on each side of the modulator. Thus, the modulator is received in a retainer which reduces flexing of its wall without inhibiting its performance.

An object of the present invention is to cause the exhaust pressure peaks to be modulated and create a smooth flow out of the assembly and at the same time reduce the pump noise. Another object of the invention is to provide a modulator mounting locator, centering and expansion limiting retainer which will limit the expansion without inhibiting the pulse reducing function intended for it. The retainer reduces flexing of the walls of the modulator and extends the fatigue life significantly.

BRIEF DESCRIPTION OF THE DRAWINGS

These and other objects and features of the invention will be apparent from the following detailed description of the preferred embodiment and best mode, appended claims, and accompanying drawings in which the various views may be briefly described as:

DETAILED DESCRIPTION

Figure 1:
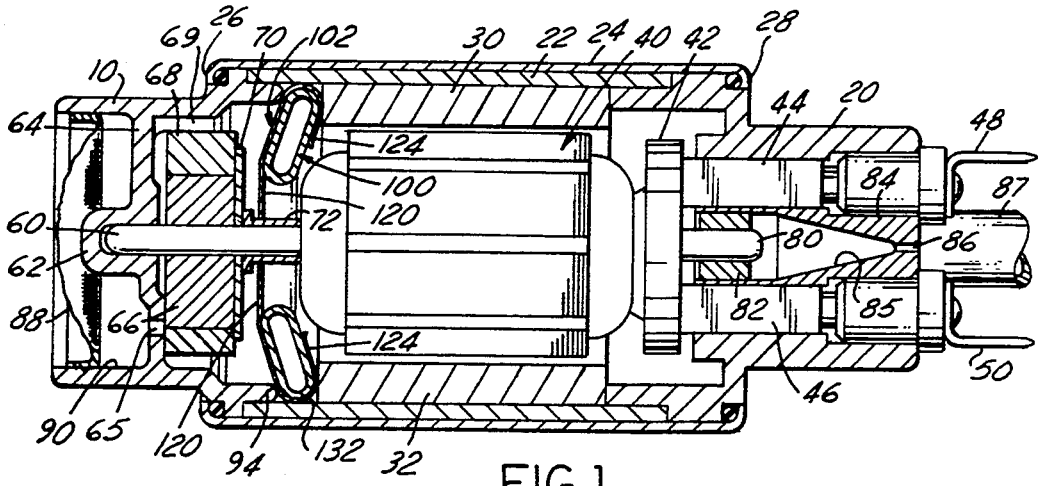
FIG. 1 is a sectional view of an electric fuel pump incorporating the pulse damper and retainer of the present invention.
Figure 2:
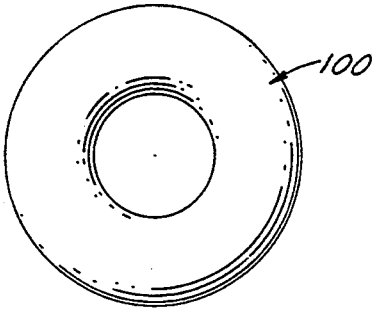
FIG. 2 is an elevational view of the toroidal pulse damper.

With reference to the drawings, FIG. 1 illustrates an electric fuel pump with an inlet housing 10 and an outlet housing 20 separated by a cylindrical field casing 22. An encompassing case cover 24 with O-ring seals at each end has ends 26,28 spun over the housings 10 & 20 to unify the assembly. Armature magnets 30 and 32 are disposed in a conventional way around a rotating armature 40 which has a commutator 42. Brushes 44 and 46 in outlet housing 20 are resiliently pressed against the face of the commutator 42 with suitable electrical connectors 48 and 50.

The armature 40 has a mounting shaft 60 journalled in a boss 62 formed in a wall 64 of the inlet housing 10. An inlet port 65 in the wall admits fuel to the inlet side of the pump which comprises an inner gear rotor 66 pressed on and permanently affixed to the shaft 60 and positioned within an outer gear rotor 68. A pump outlet port 69 is provided but pump outlet fuel may also pass around the flexible seal 70 which is free to rotate with the outer gear 68 and is pressed against the rotors by an eyelet 72 mounted between the armature and the seal. The gear teeth on the rotors 66 and 68 are preferably meshed helical gears, as described more fully in U.S. Pat. No. 4,596,519, dated Jun. 24, 1986, to reduce and smooth out pulsations in the pump output.

At the other end of armature 40, a mounting shaft 80 is journalled in a pressed-on bushing 82 in a central insert 84 in the outlet housing 20. The bushing 82 is affixed to the shaft 80 and is axially movable in the insert in a recess 85. A small vent 86 is provided at the end of the recess 85. The bushing 82 rotates with the shaft 80. An outlet nipple connection 87 is provided in a conventional way. A filter screen 88 extends over the basic opening 90 in the inlet housing 10. The inlet 10 has an inwardly extending flange 94 facing the armature magnets 30,32.

In accordance with this invention, an annular pulse damper 100 is received in a retainer 102 disposed in the housing between the inlet flange 94 and the armature magnets 30 & 32. The damper is in the shape of a toroid or doughnut with an open center and a hollow interior which is filled with a gas such as air at a superatmospheric pressure which is typically in the range of about 40 to 45 psig. Both circumferentially and in cross-section, the damper has a continuous wall and is formed as a sealed chamber preferably in a blow molding process in which the pressure of the interior enclosed gas is made superatmospheric. The interior pressure is predetermined and selected to relate to the operating pressure of the fuel discharged from the pump in which the damper is installed. Preferably, the damper is formed of a flexible plastic material resistant to hydrocarbons and alcohols such as ACETAL TM.

Due to its relatively higher internal pressure, when the damper is unrestrained and disposed in the atmosphere, it has a cross-section which is elliptical to substantially circular. However, when in the pump and while the pump is operating, the exterior of the damper is in contact with liquid fuel at a sufficiently higher pressure so that in cross-section, the damper has a generally oval configuration as shown in FIG. 1 with two generally flat elongate portions interconnected by generally opposed return bend portions in what might be called a generally racetrack configuration. As the pump is turned off and on, the pressure of the fuel on the exterior of the damper varies about 0 psig to a maximum operating pressure of the pump which is usually in the range of about 45 to 60 psig. This pressure variation would cause substantial flexing and displacement of the damper wall from a substantially circular cross-section to the racetrack cross-section if the damper were not restrained in the racetrack configuration by the retainer. This substantial flexing would significantly increase the stressing of the material of the damper, thereby greatly reducing its in-service useful life due to fatigue failure of the material. Moreover, in the close confinement of the housing between the pump and the motor, the damper could contact and interfere with the adjacent parts of the pump and the motor if it were not restrained by the retainer.

The retainer 102 is preferably stamped from a flat blank of sheet metal having at least some inherent resilience (such as spring steel) but still being sufficiently malleable that it may be formed into a relatively complex shape and will retain its shape as formed. The stamped blank has a central body 120 with a locating center hole 122 and around its periphery a plurality of equally circumferentially spaced radial fingers 124 with free ends which are preferably rounded. Preferably, at the base of each finger is a widened tab 126 extending from the central body 120 and a notch portion 130 between each tab which extends to the basic circumference of the body 120. Preferably, the edges of the fingers, tabs and notches of the blank are brushed or otherwise processed so that they do not have any sharp areas or burrs which might cut into, wear away or damage the wall of the damper during the flexing of the damper resulting from pulsations and pressure changes in the output of the fuel from the pump. Preferably, as shown in FIG. 1, the fingers and tabs are bent at an acute included angle to the plane of the base or central body 120 which is preferably about 15° to 35°.

Figure 3:
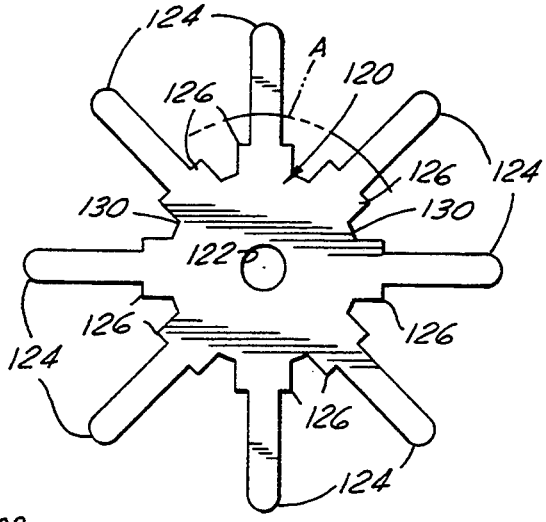
FIG. 3 is a view of a retainer sheet blank prior to assembly.
Figure 4:
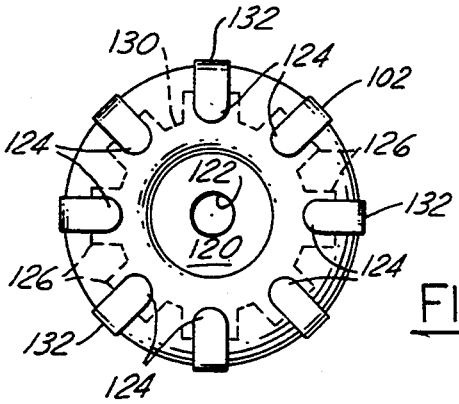
FIG. 4 is a view of the formed and assembled retainer and toroidal pulse damper prior to installation in a pump.

After the toroidal damper 100 is centered over the blank with its outer diameter lying in the vicinity of the dot-dash line A in FIG. 3, then the fingers 124 are bent around the outer periphery of the damper (as shown in FIG. 4) so that in cross-section, it has the oval or racetrack configuration shown in FIG. 1. The bight 132 of each finger is formed around the outer diameter of the toroidal damper with a return bend so that the free end of the finger overlies and preferably extends generally parallel to base portion of the finger and its associated tab 126. Preferably, as shown in FIG. 1, the tip of the free end of each finger is bent so that it is somewhat upturned away from the underlying wall of the damper. Preferably, the upturned finger tip may be formed simultaneously with bending the tab 126 and finger to their inclined position relative to the plane of the base or the central portion of the body 120 of the retainer.

In use, the inherent resilience of the confining fingers combines with the resilience of the toroidal damper to complement and enhance the absorption and dissipation of fuel pulses by the combined damper and retainer.

After the retainer blank has been positioned and formed around the pulse damper 100, as shown in FIG. 4, it is ready to be assembled with the other elements of the pump. The hole 122 in the retainer body fits over the eyelet 72 mounted between the pump armature and the seal 70. The outer periphery of the pulse element is positioned between the magnets 30 & 32, on one side, and the inner edge of the flange 94 on the other side.

Figure 5:
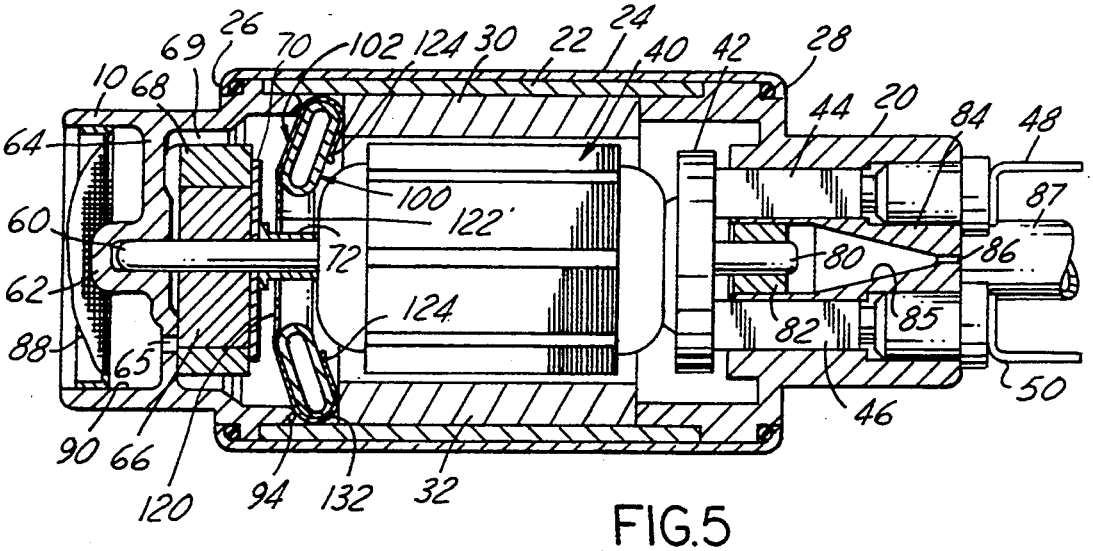
FIG. 5 is a sectional view of an electric pump incorporating the pulse damper and a modified retainer of the present invention.
Figure 6:
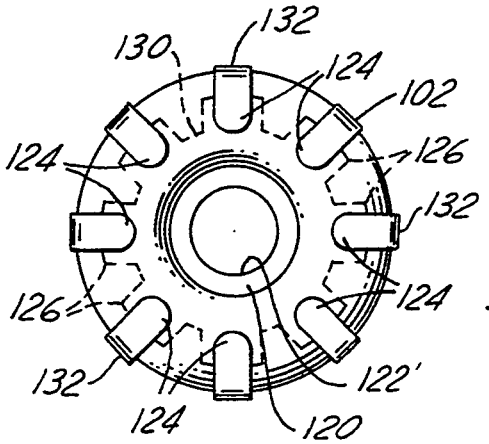
FIG. 6 is a view of the assembled modified retainer and toroidal pulse damper prior to installation in the pump.

FIG. 5 illustrates the electric fuel pump with a modified retainer 102' receiving and mounting the pulse damper 100 in the pump. The retainer and pulse damper are mounted in the casing 22 by being trapped between the inlet flange 94 and the armature magnets 30 and 32. As shown in FIG. 6, the modified retainer 102' has a central through hole 122' with a diameter which is larger than the outside diameter of the eye or bushing 72. This provides an annular space between them through which fuel can flow and isolates the bushing 72 from the retainer to insure that the retainer will not laterally displace the bushing so that it is not concentric with the axis of rotation of the armature shaft 60. Except for this enlarged central hole 122', the retainer 102' has the same construction and arrangement as the retainer 102.

In operation of the pump, the spaced fingers 124 and the tabs 126 of the retainer confine the flexible toroid damper to prevent undue expansion while allowing the required contraction and expansion during pump operation needed to dampen and absorb pulsations in the fuel discharged from the pump. When the pump is shut off, the retainer also prevents excessive flexing and movement of the damper into a circular cross-section with resulting contact and interference with adjacent parts of the pump and motor of the fuel pump assembly. The locating and retention plate significantly extends the life of the pulsing damper without interfering with its basic function and indeed enhancing its performance.

What is claimed is:

1. In a rotary fuel pump that includes an elongate housing with an inlet at one end and an outlet at the other end, a rotary pump at the inlet end and an electric motor rotating on the axis of said housing within the housing to drive the pump, that improvement which comprises a hollow and sealed pulse reducing chamber formed of flexible plastic walls with a gas such as air captured within the chamber at a pressure above ambient atmospheric pressure, said chamber being disposed in a pump pressure outlet area in the vicinity of a rotating drive shaft of the pump, and means forming a retaining plate at least partially disposed on opposite sides of said pulse reducing chamber having portions to confine the walls of the chamber against axial expansion in spaced area of said walls, said plate having a central body portion overlying the opening on one side of said toroid and having a central hole to mount on an element on the rotating axis of said pump to centrally locate said plate and said chamber.

2. In a rotary fuel pump that includes an elongate housing with an inlet at one end and an outlet at the other end, a rotary pump at the inlet end and an electric motor rotating on the axis of said housing within the housing to drive the pump, that improvement which comprises a hollow and sealed pulse reducing chamber formed of flexible plastic walls with a gas such as air captured within the chamber at a pressure above ambient atmospheric pressure, said chamber being frustoconically toroidal in shape and being disposed around a rotating drive shaft of said pump, amounting and retaining plate overlying one side of said pulse reducing chamber, and circumferentially spaced, radial fingers on said plate having portions extending over and around the periphery of said chamber with distal ends overlying the other side of said chamber.

3. A combination as claimed in claim 2 in which said fingers have an enlarged proximal end overlying the said one side of said chamber.

4. A combination as claimed in claim 3 in which said fingers are formed around the periphery of said chamber, each of said fingers having a bight located at the outer periphery of said chamber.

5. A combination as claimed in claim 3 in which the distal end of each of said fingers is provided with a radius to avoid damage to said pulse reducing chamber.

6. A combination as claimed in claim 2 in which said fingers are formed around the periphery of said chamber, the bight of said formed fingers being located at the outer periphery of said chamber.

7. A combination as claimed in claim 6 in which each of said fingers has an enlarged proximal end overlying the said one side of said chamber.

8. A combination as claimed in claim 6 in which the distal end of each of said fingers is provided with a radius to avoid damage to said pulse reducing chamber.

9. A combination as defined in claim 2 in which the distal ends of said fingers are provided with a radius to avoid damage to said pulse reducing chamber.

10. A combination as claimed in claim 9 in which each of said fingers has an enlarged proximal end overlying the said one side of said chamber.

11. A combination as claimed in claim 9 in which said fingers are formed around the periphery of said chamber, each of said fingers having a bight located at the outer periphery of said chamber.

12. A combination as claimed in claim 2 in which each of said fingers has an enlarged proximal end overlying the said one side of said chamber, wherein said fingers are formed around the periphery of said chamber, each of said fingers having a bight located at the outer periphery of said chamber, wherein the distal end of each of said fingers is provided with a radius to avoid damage to said pulse reducing chamber, and wherein said plate has a central body portion overlying the opening on one side of said toroid and having a central hole to mount on an element on the rotating axis of said pump to centrally locate said plate and said chamber.

13. A combination as claimed in claim 2 wherein said plate has a central through hole encircling the rotating drive shaft of the pump, said central through hole having a diameter larger than the outside diameter of the drive shaft so that there is an annular space between them through which fuel discharged by the pump can flow.

* * * * *